United States Patent [19]

Hain et al.

[11] Patent Number: 4,619,238

[45] Date of Patent: Oct. 28, 1986

[54] FUEL INJECTION PUMP FOR INTERNAL COMBUSTION ENGINES

[75] Inventors: Josef Hain, Leonberg; Karl-Friedrich Rüsseler, Ditzingen, both of Fed. Rep. of Germany

[73] Assignee: Robert Bosch GmbH, Stuttgart, Fed. Rep. of Germany

[21] Appl. No.: 704,293

[22] Filed: Feb. 22, 1985

[30] Foreign Application Priority Data

Mar. 20, 1984 [DE] Fed. Rep. of Germany ..... 3410146

[51] Int. Cl.[4] ..... F02M 39/00

[52] U.S. Cl. ..... 123/502; 123/449

[58] Field of Search ..... 123/502, 501, 500, 449

[56] References Cited

U.S. PATENT DOCUMENTS

| | | | |
|---|---|---|---|
| 4,359,994 | 11/1982 | Hofer | 123/502 |
| 4,378,002 | 3/1983 | Konrath | 123/502 |
| 4,395,990 | 8/1983 | Hofer | 123/502 |
| 4,430,974 | 2/1984 | Bofinger | 123/502 |
| 4,475,521 | 9/1984 | Greiner | 123/502 |
| 4,495,916 | 1/1985 | Shinoda | 123/502 |

FOREIGN PATENT DOCUMENTS

| | | | |
|---|---|---|---|
| 0157026 | 9/1982 | Japan | 123/502 |
| 0157025 | 9/1982 | Japan | 123/502 |

*Primary Examiner*—Carl Stuart Miller

*Attorney, Agent, or Firm*—Michael J. Striker

[57] ABSTRACT

In a fuel injection pump for an internal combustion chamber a device for an "early" adjustment of a fuel injection onset includes a check valve for controlling the fuel injection onset, for example in case of a cold start or low atmospheric temperatures. An unloading bypass conduit with an adjustable flow valve is connected to the check valve in parallel so that the adjustment makes possible the control of the beginning of the characteristic line of the pump relative to the characteristic line of the internal combustion engine. The device includes a pressure control valve which has an outlet opening controlled by a control piston. The cross-section of the outlet opening defines the adjustment of the characteristic line of the pump to the characteristic line of the engine.

4 Claims, 2 Drawing Figures

FUEL INJECTION PUMP FOR INTERNAL COMBUSTION ENGINES

BACKGROUND OF THE INVENTION

The present invention relates to a fuel injection pump for internal combustion engines. More particularly, the invention relates to a fuel injection pump, in which a fuel feeding pump is driven synchronously with the fuel injection pump.

In conventional fuel injection pumps of the type under consideration a pressure valve has a ball locking member which is liftable from a valve seat either by a pin of a thermoelement or by an armature of the pressure magnet.

It has been also known that a spring-loaded armature of the pulling magnet has been utilized as a valve locking member. It has been found in particular that a relatively small spring force causes an unstable armature behavior; this leads again to pressure fluctuations of the fuel being injected and makes the function of the fuel injection pump and its adjustment unstable.

SUMMARY OF THE INVENTION

It is an object of the present invention to provide an improved fuel injection pump for internal combustion engines.

It is another object of the invention to avoid the above-described disadvantages of conventional fuel injection pumps and to substantially enhance the stability of the adjustment of the injection start.

These and other objects of the invention are attained by a fuel injection pump for internal combustion engines, comprising a fuel feeding pump driven synchronously with the injection pump and having a pressure side; an adjusting piston loaded with a restoring spring force and adapted to adjust a injection start, said adjusting piston forming in said injection pump a working chamber which is in connection with said pressure side; a pressure-relief chamber; a pressure control valve including a movable control piston and having an outlet opening controlled by said control piston, said pressure side being further connected with said pressure-relief chamber via said outlet opening for generating a control pressure depending upon a number of revolutions, said control piston having a backside loaded with a restoring spring force, said pressure control valve having a pressure control chamber at said backside; a throttle conduit connecting said pressure control chamber with the pressure side of said feeding pump; a pressure-relief conduit connecting said pressure control chamber with said pressure-relief chamber; a check valve mounted in said pressure-relief conduit and being controllable in dependence upon operational parameters of an internal combustion engine; and a bypass conduit arranged parallel to said check valve and provided with a flow valve, said bypass conduit connecting said pressure control chamber of the pressure control valve with said pressure-relief chamber.

Due to the present invention the fuel pressure increase effecting the fuel injection start adjustment is produced by a flow valve positioned behind of and connected to a throttle conduit, and the valve controlled by operational parameters is no longer a pressure-maintaining valve but is rather a check valve.

The flow valve may be formed as a throttle valve or a flap valve. With this embodiment a flow valve, which is very simple in construction and reliable in function, is proposed. The allowance field of both throttles, positioned one after another, can be unfavorable in that a required adjustment, that is the adjustment of the injection start, depending on the number of revolutions, to the fuel-consumption-characteristic line of the interval combustion engine, is not obtained or is insufficient.

The flow valve in said bypass conduit may be adjustable for controlling an adjusted beginning of a characteristic line of the pump relative to a characteristic line of the internal combustion engine. This ensures a required adjustment in a very simple fashion.

There is the requirement that the adjustment of the injection onset within a given range of the number of revolutions of the internal combustion engine must be obtained. This is provided by the embodiment in which the pressure control valve has an additional outlet opening connecting said pressure control chamber with said pressure-relief chamber. The control piston has a periphery having a control edge which controls said additional outlet opening; said additional outlet opening having a through flow cross-section controlled by said control piston and defining an adjustment of the characteristic line of the pump to the characteristic line of the internal combustion engine.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
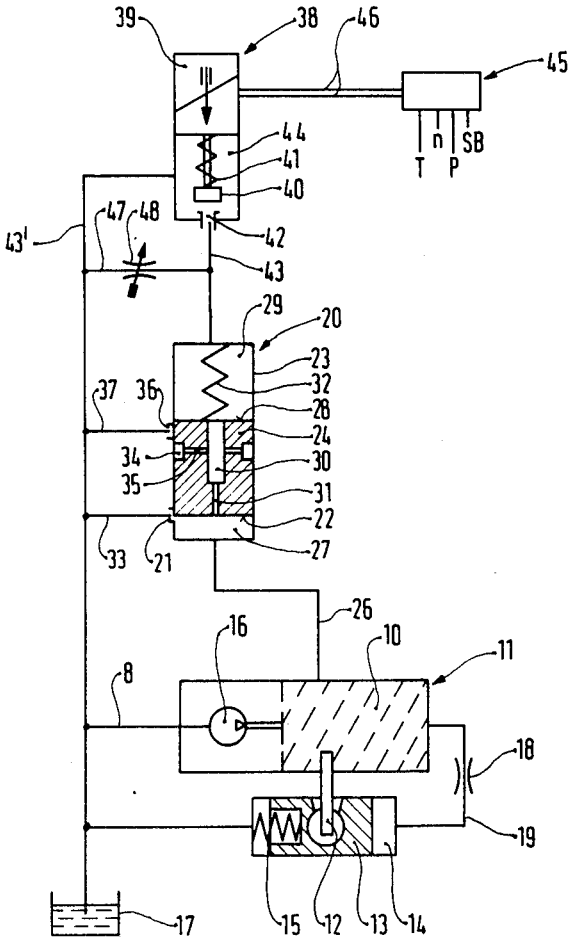
FIG. 1 is a block diagrammatic representation of the device for a fuel injection onset adjustment of the fuel injection pump for an internal combustion engine.

Referring now to the drawings in detail, and first to FIG. 1, it will be seen that in a non-illustrated conventional cam drive, a fuel injection pump 11 engages an adjustment piston 13 via a pin 12 for adjusting an injection onset. Piston 13 is displacable by pressure liquid in a work chamber 14 against the force of a restoring spring 15. The displacement in the direction of the action of the restoring spring 15 effects a piston path or stroke which is proportional to an "early" adjustment of the moment of the injection onset of the internal combustion engine. A feeding pump 16 sucks fuel from a fuel tank 17 via a conduit 8 into an inner chamber 10 of the fuel injection pump 11. The inner chamber 10 and the work chamber 14 are connected to each other by a conduit 19 provided with a throttle 18.

A pressure control valve 20 has a control piston 24 which is displaceable in a cylinder 23. The end face 22 of control piston 24 controls an outlet opening 21 of cylinder 23 and forms together with the walls of cylinder 23 a pressure chamber 27, which is in communication with the inner chamber 10 of the injection pump 11 via a pressure conduit 26. The outlet opening 21 is connected to a relieving or unloading chamber, formed by the suction side of the feeding pump 16 or container 17, via a releaving conduit 33.

A rear side of the control piston 24 forms with the walls of the cylinder 23 a control pressure chamber 29. A control spring 32 is clamped between the rear side 28 and the bottom wall of cylinder 23 so that pressure in the inner chamber 10 is automatically variable according to the principle of a spring-loaded slide valve in dependence upon the fuel amounts being fed.

The control piston 24 has an annular control groove 34 which is in a continuous connection with the control pressure chamber 29 by means of a number of radial cutoff passages 35 which open into a central bore 30. The central bore 30 and the pressure chamber 27 are connected to each other by a throttle bore 31. A second outlet or discharge opening 36, which is in connection with the releaving chamber by means of a releaving conduit 37, is arranged in the cylinder 23. The control cross-section of the outlet opening 36 is so selected that a predetermined control cross-section is formed in cooperation with the annular control groove 34.

A two-way-two-position valve 38 is formed, for example as a pulling magnet-valve, which has an energizing coil 39, and whose armature is formed by a valve-locking member 40 which is urged by a locking spring 41 towards a stationary valve seat 42 when no current flows through the energizing coil 39. The valve seat 42 is connected to the control pressure chamber 29 of the pressure control valve 20 via a relieving or unloading conduit 43. Another pressure-relief conduit 43' leads from an inner chamber 44 of the two-way-two-position valve 38 in the above described manner to the pressure relief chamber.

A control device 45 controls, depending on operational parameters, such as temperatures, pressures or a number of revolutions at the injection onset, the energizing coil 39 via electric leads 46 so that the energizing coil maintains the valve locking member 40 in the state of stress in its shown open position, and the control pressure chamber 29 becomes unloaded.

Figure 2:
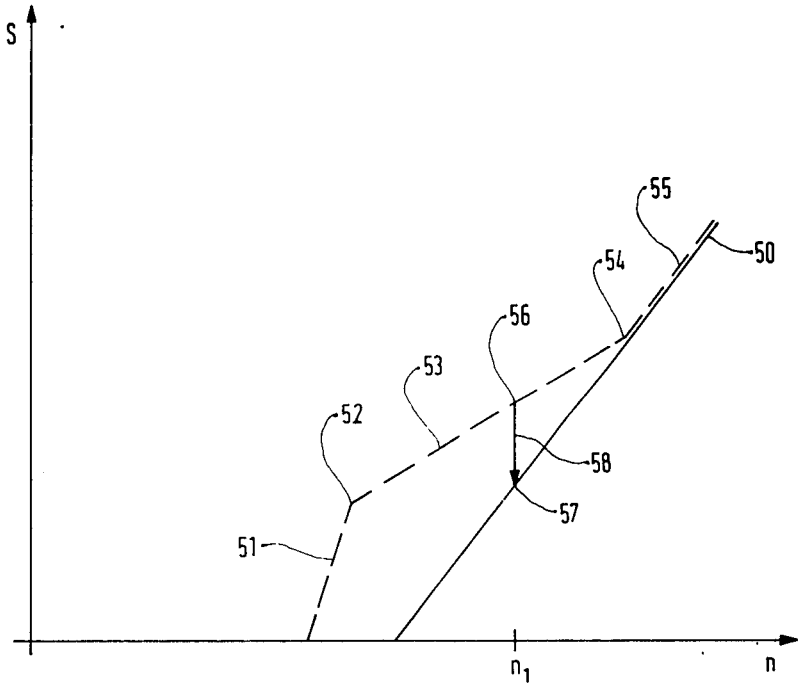
FIG. 2 is graph illustrating the relationship of the path to the number of revolutions of the pump, with an injection onset—characteristic curve during the normal function of the injection combustion engine and during the early adjustment.

Parallel to the two-way-two-position valve 38 is arranged a bypass conduit 47 which is interconnected between two relieving conduits 43 and 43'. The bypass conduit 47 has an adjustable throttle valve 48 or an adjustable flap valve operated as a flow valve. The pressure of the fuel enclosed in the inner chamber 10 of the fuel injection pump 11 is controlled with the aid of the path-number of revolutions (pressure)—diagram in the following fashion:

When the two-way-two-position valve 38 is open, as shown in the drawing, the pressure of the fuel enclosed in the inner chamber 10, which pressure depends upon the number of revolutions, loads the adjusting piston 13 in accordance with characteristic line 50 of FIG. 2. Then, depending on the operational parameter, such as temperature, or a number of revolutions, or atmospheric pressure, the deenergizing of the coil 39 of valve 38 will take place by the control device 45, so that the armature or valve-locking member 40 will close the valve seat 42, and the unloading or relieving of the control pressure chamber 29, also via the throttle valve 48 of the bypass conduit 47, will result. Thereby pressure in the inner chamber 10 will increase and an "early" adjustment of the moment of the injection will result in accordance with a characteristic line 51. At the point 52, which defines a corresponding flow cross-section of the adjustable throttle valve 48, a characteristic line 53 starts, which is adapted to the characteristics of the internal combustion engine. The rise of the characteristic line 53 defines the flow-cross section of the second outlet opening 36 of the pressure control valve 20, which flow cross-section is controlled by the control piston 24. From the point 54 the characteristic line 55 extends approximately parallel to the characteristic line 50.

The opening of the two-way-two position valve 38 is effected by the control device 45, for example when the number of revolutions is $n_1$, so that the adjusting piston 13 moves away from point 56 according to the characteristic line 58 up to the point 57 on the characteristic line 50, in accordance to which a further adjustment takes place.

It will be understood that each of the elements described above, or two or more together, may also find a useful application in other types of fuel injection pumps for internal combustion chambers differing from the types described above.

While the invention has been illustrated and described as embodied in a fuel injection pump for internal combustion chambers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a fuel injection pump for internal combustion engines, comprising a fuel feeding pump driven synchronously with the injection pump and having a pressure side; an adjusting piston loaded with a restoring spring force and adapted to adjust an injection start, said adjusting piston forming in said injection pump a working chamber which is in connection with said pressure side; a pressure-relief chamber; a pressure control valve including a movable control piston and having an outlet opening controlled by said control piston, said pressure side being further connected with said pressure-relief chamber via said outlet opening for generating a control pressure depending upon a number of revolutions, said control piston having a backside loaded with a restoring spring force, said pressure control valve having a pressure control chamber at said backside; a throttle conduit connecting said pressure control chamber with the pressure side of said feeding pump; a pressure-relief conduit connecting said pressure control chamber with said pressure-relief chamber; and a check valve mounted in said pressure relief conduit and being controllable in dependence upon operational parameters of an internal combustion engine, the improvement comprising a bypass conduit arranged parallel to said check valve and provided with a flow valve formed as a throttle valve, said bypass conduit connecting said pressure control chamber of the pressure control valve with said pressure-relief chamber.

2. The pump as defined in claim 1, wherein said flow valve in said bypass conduit is adjustable for controlling an adjusted beginning of a characteristic line of the pump relative to a characteristic line of the internal combustion engine.

3. The pump as defined in claim 2, wherein said pressure control valve has an additional outlet opening connecting said pressure control chamber with said pressure-relief chamber.

4. The pump as defined in claim 3, wherein said control piston has a periphery having a control edge which controls said additional outlet opening, said additional outlet opening having a through flow cross-section controlled by said control piston and defining an adjustment of the characteristic line of the pump to the characteristic line of the internal combustion engine.

* * * * *